US005509333A

United States Patent [19]

Rion

[11] Patent Number: 5,509,333

[45] Date of Patent: Apr. 23, 1996

[54] LOW PROFILE RATCHET ADAPTER

[76] Inventor: John D. Rion, P.O. Box 149, Weir, Kans. 66781

[21] Appl. No.: 241,761

[22] Filed: May 12, 1994

Related U.S. Application Data

[63] Continuation-in-part of Ser. No. 10,532, Jan. 28, 1993, abandoned.

[51] Int. Cl.[6] ..... B25B 13/00

[52] U.S. Cl. ..... 81/180.1; 81/177.85

[58] Field of Search ..... 81/180.1, 184, 81/185.2, 177.85, 177.1, 177.2, 60–63

[56] References Cited

U.S. PATENT DOCUMENTS

| | | | |
|---|---|---|---|
| D. 245,395 | 8/1977 | Cognevich | D8/5 |
| D. 260,355 | 8/1981 | Buzzell | D8/70 |
| 1,775,402 | 1/1925 | Mandl . | |
| 2,851,295 | 9/1958 | Chaffee | 287/119 |
| 2,982,160 | 5/1961 | Little | 81/60 |
| 4,344,340 | 8/1982 | Erickson | 81/177.85 X |
| 4,399,722 | 8/1983 | Sardo, Jr. | 81/60 |
| 4,436,005 | 3/1984 | Hanson | 81/177 |
| 4,526,069 | 7/1985 | Cecil | 81/177 |
| 4,602,534 | 7/1986 | Moetteli | 81/177.85 |
| 4,750,750 | 6/1988 | Batalorf, Jr. | 279/1 A |
| 4,907,476 | 3/1990 | Singleton | 81/57 |
| 5,361,656 | 11/1994 | Starr | 81/177.85 X |

OTHER PUBLICATIONS

Armstrong Bros. Tool Co., Catalog 820C, pp. 63, 66, 67, 70 & 71, 1973.

*Primary Examiner*—D. S. Meislin

*Attorney, Agent, or Firm*—Herzog, Crebs & McGhee

[57] ABSTRACT

In the United States, ratchet wrenches and socket sets are conventionally manufactured in six different drive sizes as follows: ¼ inch; ⅜ inch; ½ inch; ¾ inch; 1 inch; and 1 ¼ inch. Socket sets are sized to match a specific size drive cannot be interchanged without the use of an adapter. The present invention is a low profile adapter that is manufactured in various sizes to allow a ratchet wrench to drive a socket one size larger than would otherwise be suitable. For example, the adapter allow an operator to use a ¼ inch ratchet wrench to drive a ⅜ inch socket. Other sized adapters would be available for ⅜ inch, ½ inch, ¾ inch and 1 inch drive ratchet wrenches and allow them to drive sockets one size larger. Conventional adapters are rather bulky, adding from ½ inch to as much as 1 ⅝ inches to the overall height of the ratchet wrench and socket when assembled with the intermediary adapter. In certain tight working situations, the prior art adapters will not fit. In the preferred embodiment, the socket substantially abuts flush against the ratchet wrench, allowing the combination to be used in relatively tight circumstances. In alternative embodiments of the present invention, the low profile adapter is mated with a low spinner, which adds no more than ⅛ inch to the overall vertical height of the socket when mounted on the ratchet

1 Claim, 3 Drawing Sheets

LOW PROFILE RATCHET ADAPTER

CROSS-REFERENCE TO RELATED APPLICATION

The present application is a continuation-in-part of U.S. Utility Patent application Ser. No. 08/010,532, filed on Jan. 28, 1993, entitled Low Profile Drive Socket Wrench Adapter now abandoned.

BACKGROUND OF THE INVENTION

1. Field of Invention

The present invention is a low profile adapter for use with conventional sockets and ratchet wrench handles.

2. Description of the Prior Art

The conventional ratchet wrench and accompanying set of sockets is an ubiquitous tool used by professional mechanics and do-it-yourselfers alike. Socket wrench sets and individual components are readily available from such national manufacturers as Snap-On Tools Corporation of Kenosha, Wisconsin, Craftsman brand tools from Sears, Roebuck & Company; NAPA brand tools from NAPA Auto Parts and numerous other domestic and foreign suppliers.

The conventional ratchet wrench has a square drive and is normally manufactured in six different sizes in America as follows: ¼ inch; ⅜ inch; ½ inch; ¾ inch; 1 inch; and 1 ¼ inch. Professional mechanics and some do-it-yourselfers will often own two or more different sized ratchet wrenches and accompanying sets of sockets. For example, many homeowners work on relatively small types of apparatuses and will purchase a ¼ inch drive ratchet wrench and accompanying set of sockets. On occasion, the do-it-yourselfer may need something larger to apply more torque. For example, work on an automobile engine. In this circumstance, the do-it-yourselfer may purchase a ½ inch drive ratchet wrench and set of sockets, or perhaps even a ¾ inch drive.

Professional mechanics will typically own a ratchet wrench in each of the five conventional sizes with an accompanying set of sockets. Those skilled in the art will recognize that the sockets are sized and dimensioned to operate with a specific size ratchet wrench. For example, a set of sockets that are sized to operate with a ½ inch ratchet wrench will not fit directly on a ⅜ inch drive ratchet wrench or a ¾ inch drive ratchet wrench.

Those skilled in the art will be familiar with a tool which is generally referred to as an adapter. This tool is used as an intermediary component between the ratchet wrench and the socket. The adapter allows the operator to use a larger size socket with a smaller size wrench than would otherwise be functional. Adapters are commonly manufactured in the following five sizes in America: a ¼ inch adapter will fit on a ¼ inch drive ratchet wrench, allowing it to drive a socket with a ⅜ inch receptacle. A ⅜ inch adapter will fit on a ⅜ inch drive ratchet wrench, allowing it to drive a socket with a ½ inch receptacle. A ½ inch adapter will fit on a ½ inch drive ratchet wrench, allowing it to drive a socket with a ¾ inch receptacle. A ¾ inch adapter will fit on a ¾ inch drive ratchet wrench, allowing it to drive a socket with a 1 inch receptacle. A 1 inch adapter will fit on a 1 inch drive ratchet wrench, allowing it to drive a socket with a 1 ¼ inch receptacle. Conventional adapters are useful in many different situations and are often sold in combination with a typical socket wrench set.

Conventional adapters fit in between the ratchet wrench and the socket and elongate the vertical height of these three items. This is sometimes a disadvantage when working in tight quarters. For example, a conventional ¼ inch adapter will elongate the total vertical profile of the wrench and the socket by approximately ½ inch to ⅝ inch. A conventional ⅜ inch adapter will elongate the aforementioned profile by approximately ⅝ inch to ¾ inch. A ½ inch adapter will elongate the aforementioned profile by approximately ⅞ inch to 1 inch. A conventional ¾ inch adapter will elongate the aforementioned profile by approximately 1 ⅛ inch to 1 ⅜ inch. A conventional 1 inch adapter will elongate the aforementioned profile by approximately 1 ¼ inches to 1 ⅝ inches. In the preferred embodiment, the low profile adapter allows the operator to use a small sized rachet and to mate it with a larger sized socket. The preferred embodiment of the present invention does not elongate the vertical profile of the ratchet wrench and the socket. This allows the preferred embodiment to be used in certain tight circumstances which cannot be reached with a conventional adapter.

Those skilled in the art will also be aware of another intermediate apparatus known as a spinner. Like the adapter, the spinner fits intermediate between a ratchet wrench and a socket. Unlike the adapter, a spinner has an enlarged wheel, or disk, that is knurled on the outside circumference so that it can be easily manipulated by the operator's thumb. The purpose of a spinner is to allow the operator to rapidly start a bolt or a nut by using the thumb and the enlarged disk. The spinner is used primarily to speed up operations where there is a substantial amount of slack that needs to be traversed before substantial torque can be exerted by the ratchet wrench.

As far as Applicant has been able to determine, the prior art spinners are compatible only with a specific sized drive and accompanying set of sockets. For example, the spinner would engage a ¼ inch drive ratchet wrench and would fit into the receptacle of a ¼ inch socket. Applicant is unfamiliar with any spinners that include the features of an adapter; i.e., being able to go from a ¼ inch drive ratchet wrench to ⅜ inch drive socket.

Spinners are useful tools to mechanics and do-it-yourselfers; however, because they are an intermediary device, like the conventional adapter they lengthen the vertical profile of the ratchet and the socket when they are in use. For example, a ½ inch size spinner, manufactured by Williams, Part No. S-70, will increase the vertical height of the wrench and the socket by approximately 1 inch. A NAPA brand spinner, Part No. NB-15 for a ⅜ inch drive, will likewise increase the vertical profile of the rachet and the socket by approximately 1 inch. This increased vertical profile makes it difficult to use spinners and/or adapters in certain tight situations.

In several alternative embodiments of the present invention, the low profile adapter is, likewise, equipped with an enlarged disk, which acts as a spinner. The present invention, with a spinner, will not increase the vertical profile of the rachet wrench and the socket by more than ⅛ inch. This low profile is particularly useful in certain tight circumstances to speed up assembly and disassembly of certain apparatus.

U.S. Pat. No. 4,907,476, issued on Mar. 13, 1990 for a SOCKET WRENCH WITH IMPROVED HANDLE. The preferred embodiment of the wrench disclosed in the '476 patent has an outer cap, manufactured from a resilient material. The outer cap fits over a hemispherical stop on the square drive shaft. This embodiment operates in two alternative positions, which are referred to as "locked" and "unlocked." When operating in the "locked" mode, the outer cap locks onto a lug 42 so that this wrench can be moved to and fro like a conventional ratchet wrench and socket. When operating in the "unlocked" mode, the outer cap disengages the lug and the wrench is operated by a T-shaped handle. This wrench has a pair of pinion gears in the head which are operated by the T-shaped handle. Because the head includes these relatively large pinion gears, it is substantially thicker than the head of a conventional ratchet wrench which does not have these two pinion gears. Due to the increased head size of this wrench, it cannot be used in certain tight situations like a conventional ratchet wrench with the low profile adapter mounted thereon. The low profile adapter of the present invention is formed from metal and is intended to be easily attached and removed from a conventional square drive ratchet wrench that mates with conventional sockets. The outer cap of the '476 patent is formed from resilient material and is intended to stay on the wrench once it has been assembled. Because of the hemispherical stop on the drive shaft of the '476 wrench, it will not mate with conventional sockets, conventional adapters or conventional spinners unless the outer cap is placed thereon. The '476 wrench does not have the advantages of the present invention.

The present invention combines the advantages of prior art adapters and spinners with a low profile design so that, in tight circumstances, a larger socket can be used with a smaller drive ratchet wrench.

SUMMARY OF THE INVENTION

In the preferred embodiment, the low profile adapter will be manufactured in five different sizes as follows: a ¼ inch adapter to engage a ¼ inch drive ratchet wrench; a ⅜ inch adapter to engage a ⅜ inch drive ratchet wrench; a ½ inch adapter to engage a ½ inch drive ratchet wrench; a ¾ inch adapter to engage a ¾ inch drive ratchet wrench; and a 1 inch adapter to engage a 1 inch drive ratchet wrench. In the preferred embodiment, the low profile adapter does not increase the vertical profile between the rachet wrench and the socket. This enables the operator to use the low profile adapter in various, hard-to-reach areas where space is at an absolute premium.

In an alternative embodiment, the adapter will feature an enlarged disk, or spinner, which is also of a low profile dimension so that it will not increase the vertical height of the ratchet wrench and the socket by more than ⅛ inch. This alternative embodiment likewise allows an operator to use the low profile adapter in tight circumstances.

BRIEF DESCRIPTION OF THE DRAWINGS

So that the manner in which the above-recited features, advantages and objects of the present invention are attained and can be understood in detail, more particular description of the invention, briefly summarized above, may be had by reference to the embodiments thereof which are illustrated in the appended drawings.

It is noted, however, that the appended drawings illustrate only typical embodiments of this invention and are, therefore, not to be considered limiting of its scope, for the invention may admit to other equally effective embodiments.

DESCRIPTION OF THE PREFERRED EMBODIMENT

Figure 1:
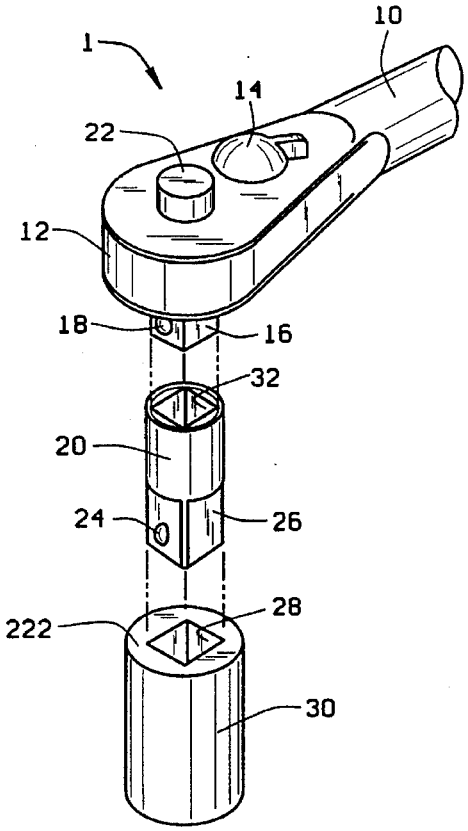
FIG. 1 PRIOR ART
FIG. 1 is an exploded perspective view of a prior art, quick-release ratchet wrench, a prior art adapter and a prior art socket.

FIG. 1 shows a prior art quick-release ratchet wrench, a prior art adapter and a prior art socket. Specifically, the prior art quick-release ratchet wrench is generally identified by the numeral 1.

Quick-release ratchet wrenches of this design are sold under the Craftsman brand by Sears, Roebuck and Company. A handle 10 extends rearwardly from the head 12 of the ratchet wrench 1. A switch 14 is mounted on the head 12 and can be moved into one of two positions to operate the ratchet in either a clockwise or counterclockwise drive mode. The structure and operation of the quick-release mechanism and the drive mechanism are well known to those skilled in the art. The square drive 16 extends from the bottom of the head 12. A ball 18 extends from one side of the square drive 16 and serves as a retaining means to hold the adapter 20 on the square drive 16.

The ball 18 is normally held in an outward position by the quick-release mechanism. When the quick-release button 22 is depressed, the ball 18 is free to move inwardly towards the center of the square drive 16. In order to mount the adapter 20 on the square drive, the operator depresses the quick-release button 22, which allows the ball 18 to move inwardly towards the center of the square drive 16. The adapter 20 will then fit onto the square drive 16. The operator then releases button 22, which forces the ball 18 into its outwardmost position, thus releasably locking the adapter 20 on the square drive 16.

Figure 12:
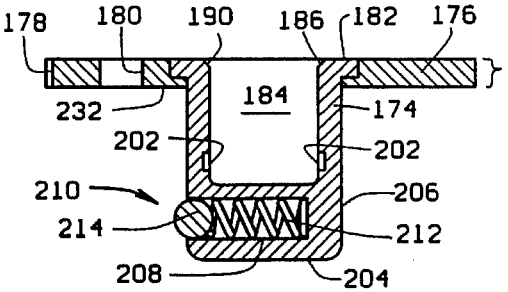
FIG. 12 is a section view of the third alternative embodiment of the low profile adapter with spinner along the line 12—12 of FIG. 11.
Figure 13:
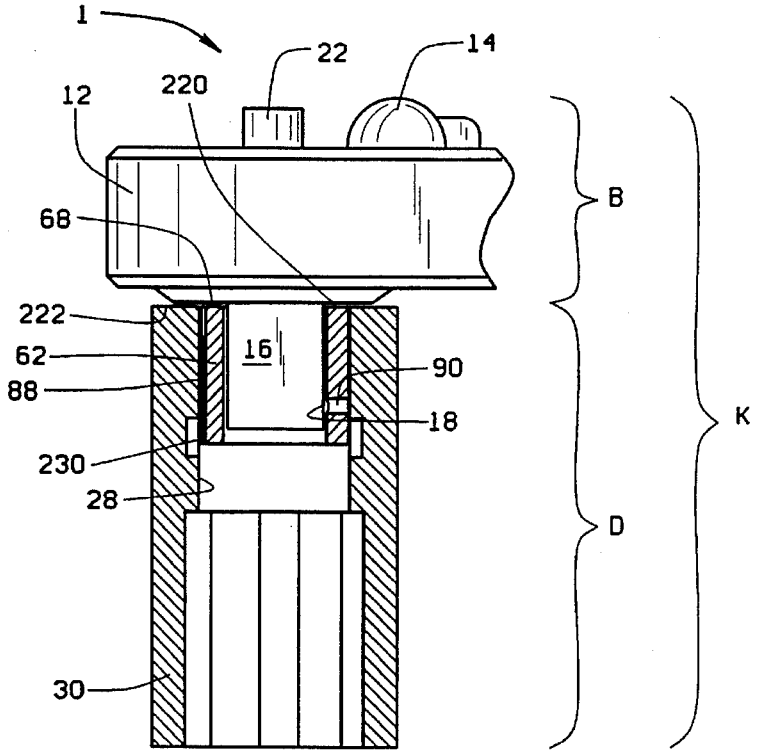
FIG. 13 is a section view of a prior art socket mounted on the low profile adapter shown in FIG. 6, mounted on the square drive of a prior art quick-release ratchet.

To remove the adapter 20, the operator again depresses the quick release button 22 and removes the adapter 20 from the square drive 16. In other words, the button 22 must be depressed to both mount the adapter 20 on the square drive 16 and to demount the adapter 20 from the square drive 16. The adapter 20 has a ball detent assembly 24 mounted in the drive shaft 26 to engage the socket 30. The socket 30 has a square receptacle 28 formed in the top 222 thereof. The receptacle 28 is sized to receive and engage the drive shaft 26 of the adapter 20 as shown in this drawing. An undercut 230, better seen in FIGS. 12 and 13, is formed inside the receptacle 28. The undercut receives the ball 24 of the adapter 20. In the alternative, the undercut 230 will receive the retainer means on the square drive of the ratchet wrench, as known to those skilled in the art.

Figure 2:
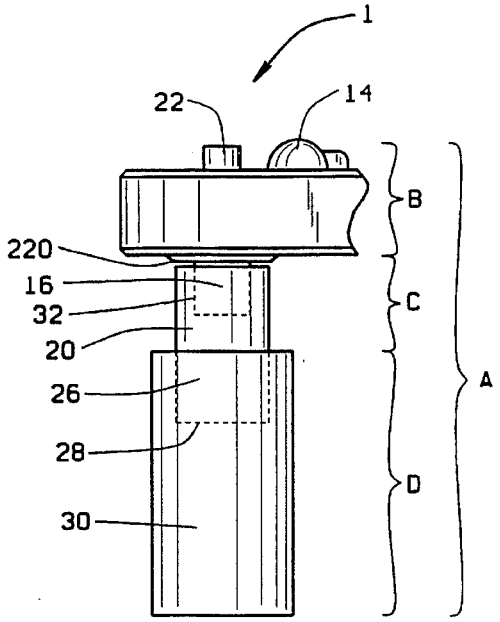
FIG. 2 PRIOR ART
FIG. 2 is a side elevation view of the prior art quick-release ratchet wrench, the prior art adapter and the prior art socket of FIG. 1 connected for operation.

FIG. 2 is a sectional view of the prior art quick-release ratchet wrench 1, the prior art adapter 20 and the prior art socket 30. The square drive 16 is shown in phantom engaging the receptacle 32 of the adapter 20. The drive shaft 26 of the adapter 20 is shown in phantom engaging the receptacle 28 of the socket 30.

Figure 3:
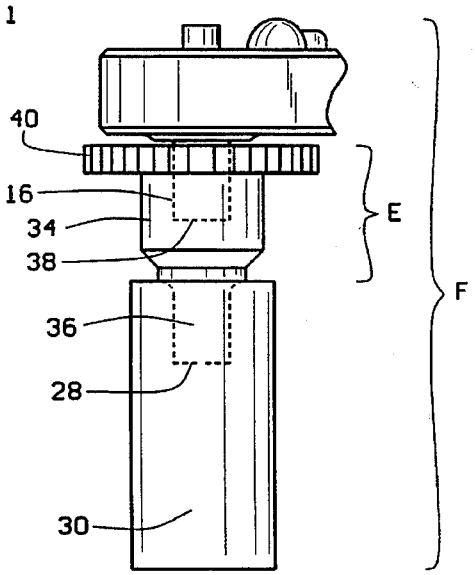
FIG. 3 PRIOR ART
FIG. 3 is a side elevation view of a prior art quick-release ratchet wrench, a prior art spinner manufactured by Williams, Model S-70, and a prior art socket.

When locked together, the ratchet wrench 1, the adapter 20, and the socket 30 have a vertical height indicated by the bracket A. This vertical height is composed of three components, as follows: the height of the ratchet itself, identified generally by the bracket B; the intermediary height of the adaptor 20, generally identified by the bracket C; and the height of the socket 30 itself, generally identified by the bracket D. In most circumstances, it is not necessary to use an adapter, as shown in FIGS. 2 and 3. In most circumstances, the size of the square drive 16 is the same as the receptacle 28 in socket 30. However, in some situations, it is useful to use a larger size socket with a smaller size drive, as shown in FIGS. 2 and 3. In this latter circumstance, the vertical height of the ratchet wrench 1 and the socket 30 is increased by the added height of the adapter represented by the bracket C in FIG. 2. In some applications, the surrounding environment will not permit use of the ratchet wrench 1, the adapter 20 and the socket 30 because of the incremental height shown by the bracket C. The present invention is designed to solve this need for a low profile adapter. In the preferred embodiment, the incremental height C is eliminated, and the operator can still use a larger size socket with a small drive ratchet wrench.

For example, a Craftsman® quick-release ¼ inch drive ratchet is a rather compact tool. The overall height of this ratchet wrench as indicated by the bracket B is slightly more than ½ inch. The added height of a conventional Craftsman® ⅜ inch to ¼ inch adapter, as shown by the bracket C, is approximately ½ inch.

Referring to FIG. 3, the prior art quick-release ratchet 1 is shown with a ½ inch square drive 16 in engagement with a prior art spinner 34, which is likewise shown in engagement with a prior art socket 30. The square drive 16 is shown in phantom engaging the receptacle 38 in the spinner 34. The drive shaft 36 of the spinner 34 is shown in phantom engaging the receptacle 28 of the socket 30.

The spinner 34 is a depiction of a Williams brand ½ inch drive spinner, Model No. S-70. The receptacle 38 of the spinner 34 is sized to engage a ½ inch square drive 16 of the ratchet wrench 1. The drive shaft 36 of the spinner 34 is likewise a ½ inch size to engage a socket set designed to receive a ½ inch square drive.

In some respects, the spinner 34 is different from the adapter 20. The adapter 20, as the name implies, allows the operator to use a larger size socket with a smaller size ratchet wrench. Unlike the adapter, the spinner 34 can only be used with a compatible ratchet wrench and socket. In FIG. 3 (the spinner), the drive 16 on the ratchet wrench is ½ inch and the receptacle 28 of the socket 30 is also ½ inch. In FIG. 2 (the adapter), the drive 16 on the ratchet wrench is ¼ inch and the receptacle 28 of the socket is ⅜ inch.

The spinner 34 adds additional height to the vertical stacking relationship of the ratchet wrench 1 and socket 30. The additional height added to this configuration is indicated by the bracket E and represents approximately 1 inch.

At the top of the spinner 34 is an enlarged disk 40 which is knurled on the outside. The knurling allows the disk to be rotated by the operator's thumb. The approximate diameter of this prior art disk is 1 ½ inches. The width of the disk is approximately 3/16 inch.

Figure 4:
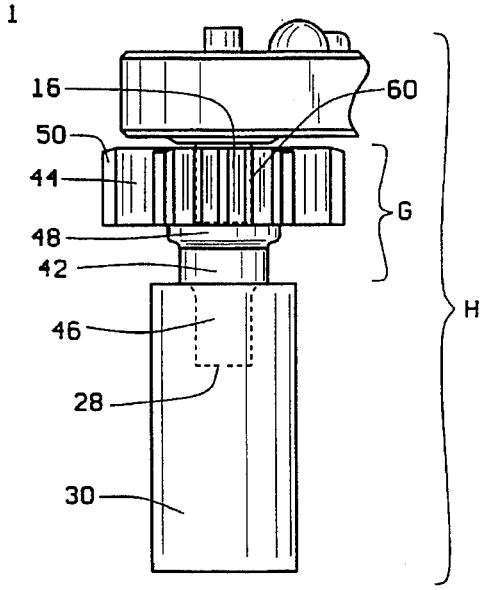
FIG. 4 PRIOR ART
FIG. 4 is a side elevation view of a prior art quick-release ratchet wrench, a prior art spinner manufactured by NAPA, Model No. NB-15, and a prior art socket.

Referring to FIG. 4, the prior art socket 30 is mounted on a prior art spinner 42, which is mounted on the prior art quick-release ratchet 1. In this particular example, the spinner 42 is manufactured by NAPA, Model No. NB-15. The enlarged disk-shaped rim 44 is formed from plastic and the drive shaft 46 and the adapter body 48 are formed from metal. There are a plurality of ridges 50 formed on the outside circumference of the enlarged disk 44, allowing it to be rotated by the operator's thumb. The spinner 42 adds additional vertical height to the arrangement of the wrench 1 and the socket 30 is indicated by the bracket F. In this particular example, the Williams ⅜ inch drive spinner, Model No. NB 15, adds approximately 1 inch of height, as shown by the bracket G. The square drive 16 of the ratchet 1 is shown in phantom. The drive shaft 46 of the spinner 42 is likewise shown in phantom. The size of the square drive 16 and the drive shaft 46 are the same. The size of the receptacle 60 in the spinner 42 is the same as the receptacle 28 in the socket 30.

Figure 5:
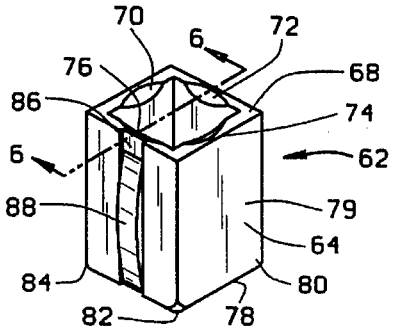
FIG. 5 is a perspective view of the low profile adapter.
Figure 6:
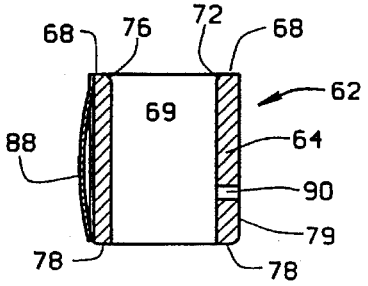
FIG. 6 is a section view of the low profile adapter along the line 6—6 of FIG. 5.

Referring to FIGS. 5 and 6, the preferred embodiment of the low profile adapter is generally identified by the numeral 62. The low profile adapter 62 is formed from a hollow body 64 which has a generally square cross section. The first end 68 defines an open ended socket 69 sized and dimensioned to receive the square drive of the ratchet handle. A first chamfer 70 is formed on the open ended sock 69 to facilitate mounting of the adapter 62 on the square drive 16 of the ratchet 1. A second chamfer 72, a third chamfer 74, and a fourth chamfer 76 are likewise formed on the open ended sock 69 to facilitate mounting of the square drive 165.

The second end 78 of the body 64 defines a drive shaft 79 sized and dimensioned to be inserted into the receptacle 28 of the socket 30. Drive shaft 79 is larger than the socket 69, allowing the operator to use a larger set of sockets than would otherwise be available for use with the ratchet wrench in question. The corners 80, 82 and 84 and the fourth corner, not shown in the drawing, are slightly rounded to facilitate insertion into the receptacle 28 of the socket 30. A channel 86 is formed on the exterior of the body 64 and is sized and dimensioned to receive a leaf spring 88 which is pressed to fit or is peened into place. The leaf spring 88 bows out slightly from the body 64 to engage the receptacle 28 of the socket 30 to removably lock the socket 30 on the low profile adapter 62.

An aperture 90 is formed in a sidewall of the body 64 to receive the ball 18 on the square drive 16 of the ratchet wrench 1. The drawings show only one aperture to receive the ball 18; however, it would be equivalent to form such an aperture in two or more sidewalls of the body 64.

The leaf spring 88 is one means that can be used to removably lock the adapter 62 on the socket 30. A simple, one-wire spring bowed slightly outward would also be equivalent for retaining the socket on the adapter 62.

To remove the adapter 62 from a socket 30, the operator places an elongate hook, not shown in the drawings, under the second end 78 or in the aperture 90. The operator then pulls the adapter 62 out of the receptacle 28 with the hook. Removal of the second alternative embodiment, as shown in FIGS. 9 and 10, is likewise accomplished with a hook.

Figure 7:
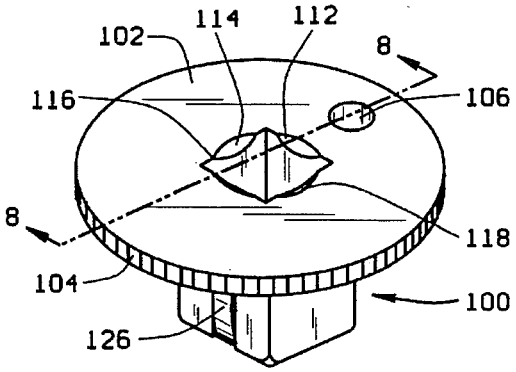
FIG. 7 is a perspective view of an alternative embodiment of the low profile adapter with a spinner.
Figure 8:
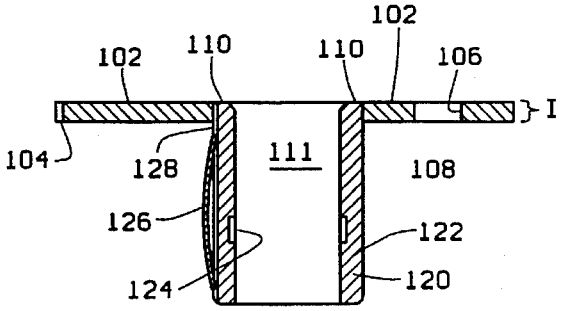
FIG. 8 is a section view of the alternative embodiment with spinner along the line 8—8 of FIG. 7.

Referring to FIGS. 7 and 8, a first alternative embodiment of the low profile adapter is generally identified by the numeral 100. This alternative embodiment includes a spinner which is an enlarged circular disk 102 that is manipulated by the thumb of the operator to turn the socket 30 and the adapter 100. The disk 102 has a plurality of seriations 103, cross-hatching or ridges about the outside circumference thereof. An optional aperture 106 is formed transversely in the disk 102 and can be used to mount the adapter 100 on a hook or other type of mounting bracket, not shown in the drawings. The width of the disk 102, as indicated by the bracket I, is no more than ⅛ inch to ensure that the adapter will fit in tight places. The adapter 100 includes a hollow body 108, having a generally square cross section. The first end 110 of the body 108 defines an open ended socket 111, sized and dimensioned to receive the square drive 16 of the ratchet wrench 1. A first chamfer 112, a second chamfer 114, a third chamfer 116 and a fourth chamfer 118 are formed on the interior of the first end 110 to facilitate mounting on the square drive 16. The second end 120 of the body 108 defines a drive shaft 122 sized and dimensioned to insert in the receptacle 28 of socket 30. Drive shaft 22 is larger than the socket 111, allowing the operator to use a larger set of sockets than would otherwise be available for use with the ratchet wrench in question. A recess 124 is formed on the interior of the body 108 and is sized and dimensioned to receive the ball 18 on the square drive 16 of the ratchet wrench 1. A leaf spring 126 is mounted in a channel 128 on the exterior of the body 108. The leaf spring 126 protrudes slightly from the body 128 and releasably attaches the socket 30 on the adapter 100. A single spring or bowed wire is equivalent to the leaf spring 126.

Figure 9:
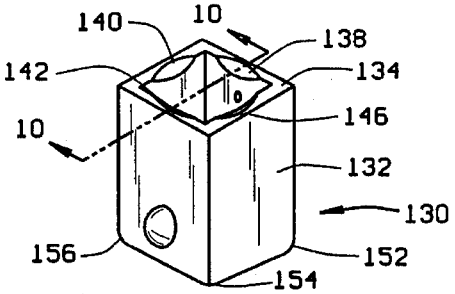
FIG. 9 is a perspective view of a second alternative embodiment of the low profile adapter.
Figure 10:
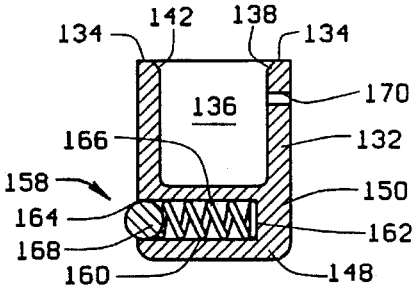
FIG. 10 is a section view of the second alternative embodiment of the low profile adapter along the line 10—10 of FIG. 9.

Referring to FIGS. 9 and 10, a second alternative embodiment of the low profile adapter is generally identified by the numeral 130. The adapter has a generally square cross sectional body 132. The first end 134 of the body 132 defines a square cup 136, sized and dimensioned to receive the square drive 16 of the ratchet wrench 1. A first chamfer 138, a second chamfer 140, a third chamfer 142 and a fourth chamfer 146 are formed on the inside of the first end 134 to facilitate insertion of the square drive 16 in the cup 136.

The second end 148 of the body 132 defines a drive shaft 150, which is sized and dimensioned to insert into the receptacle 28 of the socket 30. The drive shaft 150 is larger than the cup 136, allowing the operator to use a larger set of sockets than would otherwise be available for use with the ratchet wrench in question. The bottom corners, 152, 154 and 156 of the drive shaft 150 are slightly rounded to facilitate insertion of the drive shaft 150 into the receptacle 28 of the socket 30. A ball detent assembly is generally identified by the numeral 158. A bore 160 is formed in the second end 148 of the body 132. One end of the bore 162 is blocked and the second end of the bore 164 is open. A coil spring 166 is placed in the bore 160 and a ball 168 is placed against the spring in the bore 160. The open end 164 of the bore is then peened slightly to capture the ball 168 in the bore 160. The ball 168 can move from an "out" position, as shown in FIGS. 9 and 10, to an "in" position, not shown in the drawings. When the adapter 130 is pressed into the receptacle 28 of the socket 30, the ball 168 is pressed to the "in" position, allowing the adapter to be inserted into the socket. When the adapter bottoms out in the socket, the ball 168 moves to the "out" position in an undercut 23 in receptacle 28 of the socket 30, better shown in FIG. 14.

The body 132 has an aperture 170 formed therein which extends from the cup to the exterior of the body 132, as shown in FIG. 10. The aperture 170 is positioned to engage the ball 18 on the square drive 16 of the ratchet 1. One or more apertures could be formed in the sidewalls of the body 132 and is considered equivalent for purposes of this specification.

Figure 11:
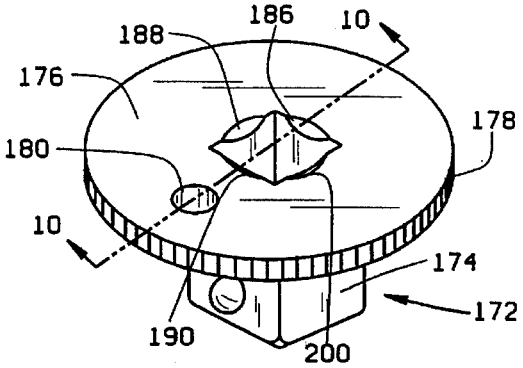
FIG. 11 is a perspective view of the third alternative embodiment of the low profile adapter with spinner.

Referring to FIGS. 11 and 12, the third alternative embodiment of the low profile adapter is generally identified by the numeral 172. The adapter 172 includes a body 174 and an enlarged circular disk 176. The width of the disk is generally identified by the bracket J and is no more than ⅛ inch.

Knurling 178, ridges or cross-hatching is placed on the outside circumference of the disk 176 so that the adapter can be manipulated by the thumb of the operator. An aperture 180 is formed transverse in the disk 176 so that the adapter 172 can be conveniently stored on a peg or other mounting bracket, not shown in the drawing. The first end 182 of the body 174 defines a square cup 184 sized and dimensioned to receive the square drive 16 on the ratchet wrench 1. A first chamfer 186, a second chamfer 188, a third chamfer 190 and a fourth chamfer 200 are formed in the exterior edges of the cup 184 to facilitate easy insertion of the square drive 16. Near the bottom of the cup 184 is an undercut 202 which is sized and dimensioned to receive the ball 18 on the square drive 16 to releasably lock the adapter 172 on the square drive 16 of the ratchet wrench 1. The second end 204 of the body 174 defines a drive shaft 206 which is sized and dimensioned to engage the receptacle 28 of socket 30. The size of the drive shaft 26 is larger than the size of the cup 184, allowing the ratchet wrench to be used with a socket that is one size larger than would normally be functional on the wrench in question. A bore 208 is formed in the second end 204 of the body 174. The bore 208 receives a ball detente assembly, generally identified by the numeral 210. A spring 212 is placed in the bore 208 and is captured therein by a ball 214 which is held in place in the bore 208 by peening the mouth thereof.

The ball 214 has an "in" position as shown in the drawings and an "out" position, not shown in the drawings. When the adapter 172 is inserted in the receptacle 28 of the socket 30, the ball 214 moves from the "out" position to the "in" position, allowing the drive shaft 206 to fit inside the receptacle 28. When the adapter 172 bottoms in place on the socket 30, the ball 214 moves to the "out" position in the undercut provided as better shown in FIG. 14.

Referring to FIG. 13, the conventional quick-release ratchet 1 is shown in side elevation view. The preferred embodiment of the low profile adapter 62 is mounted on the square drive 16 of the ratchet wrench 1. The ball 18 on the square drive engages the aperture 90, releasably locking the adapter 62 on the square drive 16. The socket 30 is mounted on the drive shaft 79 of the adapter 62 and has depressed the leaf spring 88, thereby removably locking the socket 30 on the adapter 62.

It should be noted that the first end 68 of the adapter 62 substantially abuts flush against the lower surface 220 of the ratchet wrench 1. Likewise, the top 222 of the socket 30 substantially abuts flush against the bottom surface 220 of the rachet wrench 1. When the socket 30 and the adapter 62 are mounted on the square drive 16 of the ratchet wrench 1, the total vertical height of these components is indicated by the bracket K. The most important thing about the low profile adapter 62 is that it allows the socket 30 to substantially abut flush against the ratchet wrench, as shown in FIG. 13. This allows the ratchet wrench 1 and the socket 30 to fit into tight places where conventional adapters, such as those shown in FIG. 2, simply will not fit. The overall vertical height of the three-part assembly of the prior art adapter shown in FIG. 2 and indicated by the bracket A is approximately ½ inch taller than the assembly shown in FIG. 13, represented by the bracket K.

In some situations, this ½ inch makes the difference between being able to use a ratchet and having to use a box end wrench. Because mechanics are billed at relatively high hourly rates, anything that can be done to speed up and expedite assembly and disassembly of various machines is important to consumers and the public in general. Those skilled in the art will recognize that the second alternative embodiment with the adapter 130, shown as FIGS. 9 and 10, can likewise be fitted into a socket 30 so that the socket 30 substantially abuts flush against the ratchet wrench 1. The preferred embodiment 62 and the second alternative embodiment 130 have substantial height advantages over the prior art adapter shown in FIG. 2 because they eliminate the unnecessary space as shown by the bracket C in FIG. 2.

Figure 14:
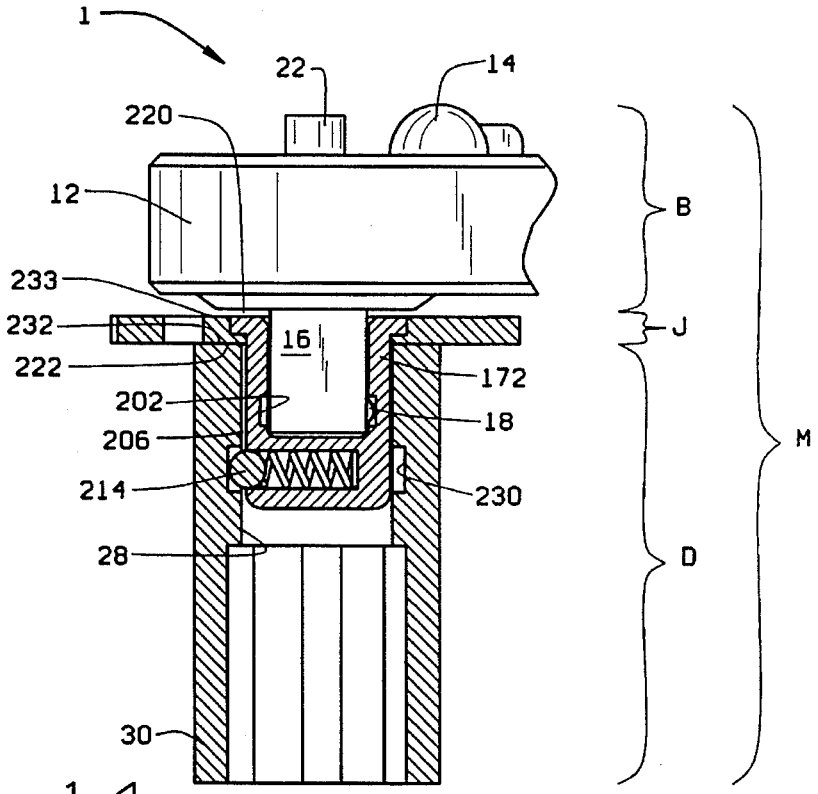
FIG. 14 is a section view of a prior art socket mounted on the third alternative embodiment of FIG. 12, mounted on a prior art quick-release ratchet wrench.

Referring to FIG. 14, the socket 30 is mounted on the third alternative embodiment of the adapter 172 which is mounted on the square drive 16 of the ratchet wrench 1. The ball 214 is shown in the "out" position and has engaged the undercut 230 on the interior of the socket 30. The ball 18 on the square drive 16 is shown in the "out" position and has engaged the undercut 202 and the adapter 172. It should be noted that the top 222 of the socket 30 substantially abuts against the bottom side 232 of the disk 176 of the adapter 172. In other words, as shown in the drawing, the socket 30 substantially abuts flush against the adapter 172. Likewise, the top surface 233 of the adapter 172 substantially abuts flush against the lower surface 220 of the ratchet wrench 1. The width of the disk 176 is shown by the bracket J and does not exceed ⅛ inch.

The overall height of the socket 30, the adapter 172 and the ratchet wrench 1 are indicated by the bracket M. This vertical height is substantially less than the vertical height of prior art spinners, as shown by the brackets F and H in FIGS. 3 and 4 and in prior art adapters, as shown by the bracket A in FIG. 2. In prior art devices, the spinner shown in FIG. 3 has an added offset of approximately 1 inch, as shown by the bracket E. The prior art spinner shown in FIG. 4 likewise has an added off-height of approximately 1 inch, as indicated by the bracket G. The required height of the present invention allows it to be used in certain situations that cannot be addressed by prior art spinners, as shown in FIGS. 3 and 4.

While the foregoing is directed to the preferred embodiment of the present invention, other and further embodiments of the invention may be devised without departing from the basic scope thereof, and the scope thereof is determined by the claims which follow.

What is claimed is:

1. A low profile adapter for use with a ratchet wrench and a plurality of separate sockets the wrench including a square driver of a predetermined geometry, each one of the plurality of sockets having a square drive cavity larger than the predetermined geometry of the square driver, each one of the plurality of sockets also having a driving cavity with a predetermined geometry that mates with a nut or bolt of like predetermined geometry, said low profile adapter being provided for interconnection between the square driver of the ratchet wrench and the square drive cavity of each of the plurality of sockets, said low profile adapter comprising:

a. a thin disk-shaped rim having a wrench seating side, a socket support side, and a knurled outer surface intermediate said seating side and said support side;

b. an adapter drive shaft disposed on said socket support side of said rim and extending axially outward therefrom, said adapter drive shaft having a predetermined geometry ratingly receivable in said square drive cavity of each of said plurality of separate sockets;

c. an adapter drive cavity disposed on said seating side of said rim and extending through said rim and into said adapter drive shaft, said adapter drive cavity constructed with a geometry selected to mate with the square driver;

d. a ball detent assembly, including a ball and spring located in said adapter drive shaft below said adapter cavity, said ball to engage in the socket drive cavity and removably lock the socket thereon; and e. said low profile adapter positioned intermediate one of said plurality of sockets and the ratchet wrench wherein the displacement between the ratchet wrench and the socket is minimized.

* * * * *